US009308657B2

(12) United States Patent
Bruno

(10) Patent No.: US 9,308,657 B2
(45) Date of Patent: Apr. 12, 2016

(54) BLADE SUPPORT FOR MULTI-BLADE RAZOR CARTRIDGES

(75) Inventor: Michael Hal Bruno, Burlington, MA (US)

(73) Assignee: The Gillette Company, Boston, MA (US)

( * ) Notice: Subject to any disclaimer, the term of this patent is extended or adjusted under 35 U.S.C. 154(b) by 1592 days.

(21) Appl. No.: 12/156,149

(22) Filed: May 30, 2008

(65) Prior Publication Data

US 2009/0293281 A1 Dec. 3, 2009

(51) Int. Cl.
*B26B 21/22* (2006.01)
*B26B 21/40* (2006.01)

(52) U.S. Cl.
CPC ..... *B26B 21/222* (2013.01); *B26B 21/4012* (2013.01)

(58) Field of Classification Search
CPC ..... B26B 21/222; B26B 21/4012
USPC ..... 30/50, 329–339, 54, 34.2, 57; 279/9.1
See application file for complete search history.

(56) References Cited

U.S. PATENT DOCUMENTS

| | | | | |
|---|---|---|---|---|
| 1,351,713 | A * | 8/1920 | Barry | 30/50 |
| 1,425,463 | A * | 8/1922 | Fischer | 30/61 |
| 1,493,788 | A * | 5/1924 | Matthews | 30/50 |
| 4,492,024 | A | 1/1985 | Jacobson | |
| 4,498,235 | A | 2/1985 | Jacobson | |
| 4,516,320 | A * | 5/1985 | Peleckis | 30/49 |
| 4,573,266 | A | 3/1986 | Jacobson | |
| 4,586,255 | A * | 5/1986 | Jacobson | 30/41 |
| 4,621,424 | A | 11/1986 | Jacobson | |
| 4,932,122 | A * | 6/1990 | Shurland et al. | 30/50 |
| 5,313,706 | A * | 5/1994 | Motta | B26B 21/227 30/47 |
| 5,666,729 | A | 9/1997 | Ferraro | |
| 5,761,814 | A | 6/1998 | Anderson et al. | |
| 6,430,814 | B1 | 8/2002 | Solow | |

(Continued)

FOREIGN PATENT DOCUMENTS

| | | |
|---|---|---|
| KR | 100749925 | 8/2007 |
| WO | WO 2008/002069 | 1/2008 |
| WO | WO 2009/057069 A1 | 5/2009 |

OTHER PUBLICATIONS

PCT International Search Report with Written Opinion in corresponding Int'l appln. PCT/US2009/042264 dated Jul. 9, 2009 (12 pgs).

*Primary Examiner* — Sean Michalski
(74) *Attorney, Agent, or Firm* — John M. Lipchitz; Kevin C. Johnson; Steven W. Miller

(57) ABSTRACT

The invention provides a razor cartridge with multiple blades and peg(s) or pegged support members that aid in the control of the blades by restricting fore and aft blade movement, which in turn, reduces the amplitude of blade deflection and/or vibration during shaving. This reduction provided by the pegs improves shaving performance. Blades rest between pegs which are rounded or shaped such that the blade bottom portion contacts the peg at one point, forming a single line of contact. The pegs may be in a slalom-like, linear (with one or more peg columns), or offset arrangement. Pegs or pegged support members may be at any location of the razor blade assembly; for instance, at the center and/or at blade slot ends. Pegs may each be of different shapes and may or may not be equidistant or at the same heights as each other, depending on blade spans and exposures.

8 Claims, 14 Drawing Sheets

(56) References Cited

U.S. PATENT DOCUMENTS 6,877,227 B2 * 4/2005 Santhagens Van Eibergen et al. ..... 30/50
6,948,249 B2 * 9/2005 Barone et al. ..... 30/41
2002/0157256 A1 * 10/2002 Barone ..... 30/41
2004/0255467 A1 12/2004 Lembke et al.
2007/0056167 A1 3/2007 Richard et al.
2009/0193659 A1 8/2009 Park et al.

* cited by examiner

BLADE SUPPORT FOR MULTI-BLADE RAZOR CARTRIDGES

FIELD OF THE INVENTION

This invention relates to multi-blade razor cartridges, and more particularly to methods and components for supporting the blades in these cartridges.

BACKGROUND OF THE INVENTION

Multi-blade razor cartridges have been developed to provide a close comfortable shave, but these cartridges can still cause skin irritations, such as nicks and cuts.

SUMMARY OF THE INVENTION

In one aspect, the invention features, in general, a razor blade unit including a guard arranged at a front portion of the housing, a cap arranged at a rear portion of the housing, a plurality of elongate blades each including a sharp top edge and a bottom portion having front and back sides and being arranged essentially in parallel between the guard and the cap, wherein each blade optionally includes a blade carrier, and a plurality of pegs each arranged to contact and support at least one of the bottom sides of at least one of the blades or at least one of the bottom sides of the blades including blade carriers, wherein an intersection between each peg and each blade forms a single line of contact. In another aspect, the unit includes at least one support member on which the plurality of pegs is arranged.

Particular embodiments of the invention include one or more of the following features. In one particular embodiment, the pegs are disposed in a slalom-like arrangement. In another, the pegs form one column of pegs in a linear arrangement. In yet another, the pegs form two columns of pegs in a linear arrangement. The plurality of pegs can be of any shape wherein the shape provides a single line of contact at the intersection with the bottom sides of the plurality of blades. In one aspect, each of the plurality of pegs is round or cylindrically shaped. In yet another embodiment, each peg has a width that is greater than a thickness of the blades, with a width of about 0.1 to about 0.3 mm, a breadth of from about 2.0 to about 5.0 mm, and a depth of from about 1.5 to about 3.0 mm. The plurality of pegs can be made of an elastomeric material, a plastic or a metal. The at least one support member is located anywhere in the housing. In one embodiment, the at least one support member is located centrally in the housing perpendicular to the blades and in another, at blade slot ends. In another aspect of the invention, the pegs may be equidistant from each other or not, and may be at different heights. In another aspect of the invention, the line of contact width is less than about 0.05 mm and the line of contact length is greater than about 0.34 mm.

In yet another aspect of the invention, a method of reducing vibration of one or more blades during use of a multi-blade razor blade unit is provided by shaving skin with the razor blade unit described above, wherein vibrations of one or more blades are reduced compared to shaving with a razor blade unit without the at least one support member. Only one point of contact is formed between each peg and each blade. In an aspect of the present invention, the point of contact formed between each peg and each blade is a line.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below.

Other features and advantages of the invention will be apparent from the following detailed description, and from the claims.

BRIEF DESCRIPTION OF DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

The invention provides new components and methods to improve the shaving performance of multi-blade razors by introducing into the razor cartridge, also referred to herein as a razor blade assembly, cylindrical pegs to provide support and aid in the control of each of the blades (and/or metal blade carriers) by restricting fore and aft blade movement, which, in turn, reduces the amplitude of blade vibration and/or deflection during shaving. By reducing either the blade deflection or the blade vibration ("chatter"), the pegs improve overall shaving performance.

Figure 1A:
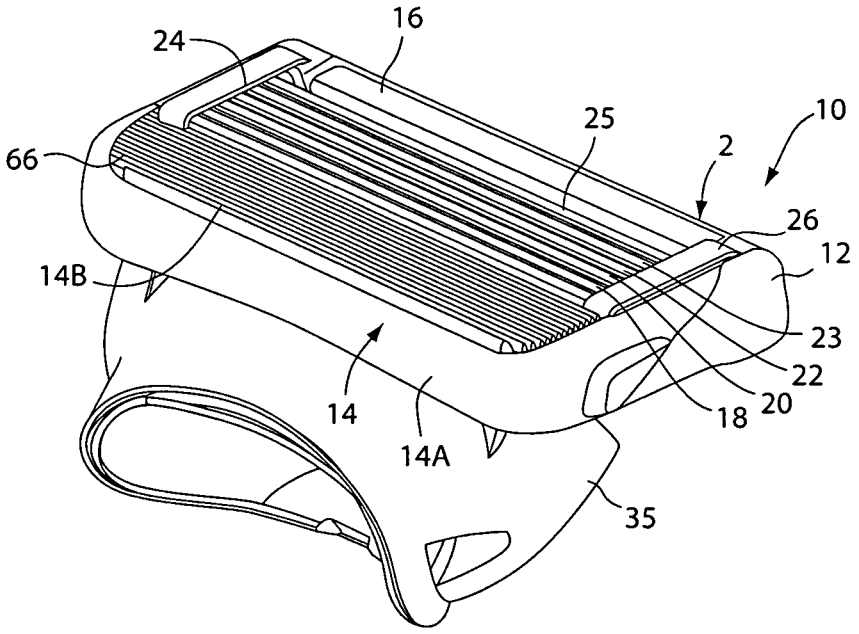
FIG. 1A is a perspective view of a razor blade assembly having five blades.

FIG. 1A shows a razor blade cartridge or unit 10 having five blades designed for mounting on a handle having a pivotal connecting structure, e.g., by means of a connecting member, as shown at 35.

A razor blade unit with a connecting member is referred to herein as a razor blade assembly. Alternatively, the razor blade cartridge can be connected by other means to a reusable handle or permanently attached to a handle to form a disposable razor. A reusable handle, for example, is described in U.S. Pat. No. 4,573,266 or in U.S. patent application Ser. No. 10/799,940.

Razor blade unit 10 includes housing 12, which may be plastic, guard 14 at the front of housing 12, cap 2 at the rear of the housing 12 and having disposed therein lubricating strip 16, and five blades 18, 20, 22, 23, and 25 in a blade mounting portion of housing 12 between guard 14 and lubricating strip 16. Primary blade 18 is nearest the guard, secondary blade 20 is next nearest the guard, and so on until the fifth blade 25 is furthest from the guard.

Alternatively, the razor blade unit can include two, three, four, or more than five blades. It is desirable to provide a plurality of blades to provide more closeness and control over shaving performance by providing a greater degree of precision adjustment in determining the shaving geometry.

Figure 1B:
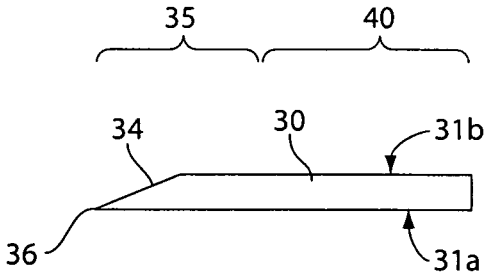
FIG. 1B is a side view of a razor blade
Figure 1C:
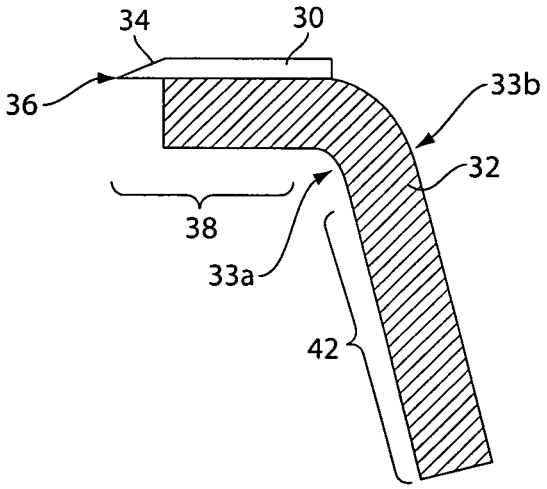
FIG. 1C is a side view of a razor blade with a carrier.

In FIG. 1A, the cap 2 has an upper surface portion 3. Lubricating strip 16 is received in cap 2 at the rear of housing 12. Blades 18, 20, 22, 23, and 25 each include a separate leading edge generally directed towards the guard 14. The leading edges can be formed as sharpened cutting edges. Metal clips 24 and 26 at the two sides of housing 12 retain the ends of blades 18, 20, 22, 23, and 25. Blades 18, 20, 22, 23, and 25 (which, as shown in FIG. 1B, can be made of a single piece of metal or as shown in FIG. 1C of a metal blade connected to a blade carrier, e.g., made of metal or plastic) can also be formed fixed in the housing 12, but may be resiliently mounted, and are biased to their raised, at-rest positions (that is, not loaded by shaving forces) via plastic leaf-spring arms (not shown) that are integral with plastic housing 12 and extend in from both sides thereof. The plurality of blades in the present invention may also be bent blades or blades that are bent without blade carriers (not shown) as described in detail in U.S. Pat. No. 6,804,886.

Guard 14 is typically a unitary molded member that can be formed of a rigid plastic at the bottom (14A), and an elastomeric material at the top (14B). The elastomeric material is chosen to provide flexibility for ribs 66, e.g., as is described in detail in U.S. Pat. No. 5,249,361. The tips of ribs 66 are in a plane that is about half-way between a plane that passes through the cutting edges of the blades 18, 20, 22, 23, and 25, and the top of clips 24, 26. The raised tips provide effective shielding of the blades. The tips also exert a traction force on the skin to stretch it and raise hairs before the primary blade, thus reducing overall cutting force.

When the razor blade unit 10 includes a connecting member 35 which removably and pivotally connects the assembly 10 to a handle (not shown), it is referred to herein as a razor blade assembly. Such a razor blade assembly can be used with a reusable handle. Alternatively, the razor blade unit can be fixed to a handle in a relatively permanent fashion to form a disposable razor.

During shaving, blades 18, 20, 22, 23, and 25 may be independently resiliently movable with respect to housing 12, and housing 12 pivots with respect to the handle with the result that the cutting edges tend to follow the contours of the skin surface. All three, four, or five (or more) blades can have sharp cutting edges to cut body or facial hairs at three, four, or five locations simultaneously. Furthermore, it may be advantageous to set the blades to have different exposures, e.g., increasing exposure progressing from the primary blade to the tertiary blade, e.g., as is described in U.S. Pat. No. 6,212,777. Additionally, different blade spans can be set between groups of two adjacent elements that contact the skin, e.g., as also described in detail in U.S. Pat. No. 6,212,777.

As shown in detail in FIG. 1B, each blade of FIG. 1A can be made of a single piece of metal (metal blade 30). Each blade 30 has a cutting edge 34 and a tip 36. Blade 30 has a sharp top edge portion 35 and a bottom portion 40. The blade 30 has front and back sides, 31*a* and 31*b* respectively. Therefore, it follows that bottom portion 40 has a bottom front side and a bottom back side, or essentially two bottom sides.

Each blade of FIG. 1A can also include a blade 30 as in FIG. 1C and a blade carrier (or support) 32, both made of metal, and permanently connected to each other, e.g., by welding, such as spot welding, adhesives, or other known methods. Blade 30 with carrier 32 similarly has a cutting edge 34 and a tip 36 and front and back sides, 33*a* and 33*b* respectively.

When the blades include a blade carrier, the bottom portion 40 of blade 30 of FIG. 1B is functionally equivalent to the bottom portion or base side 42 of the blade carrier 32 of FIG. 1C. Similarly, the sharp top edge portion 35 of FIG. 1B is functionally equivalent to the sharp top edge portion 38 of FIG. 1C. As mentioned above, the blades of the present invention may also be of the bent blade type.

The razor blade unit further comprises one or more pegs. The purpose of the new pegs or pegged support members is to improve shaving performance. The system may have one, two, three, or more pegs for supporting a bottom side of each of the two or more blades (or bottom (base) side of the blade carriers) in the multi-blade cartridge. The pegs may or may not be arranged on a support member. Blades rest in between the pegs such that the bottom side of the blade is supported by a peg such that they intersect at a single point of contact or a single line of contact formed down the surface of the blade in accordance with the present invention. This is in contrast, as will be described below, with the support member 50 shown at FIG. 1D, where the intersection or point of contact for blades between slots is a two-dimensional surface 52, thereby providing surface to surface contact.

The embodiments described herein will describe intersections between pegs and blades that form a novel single line of contact.

Figure 2:
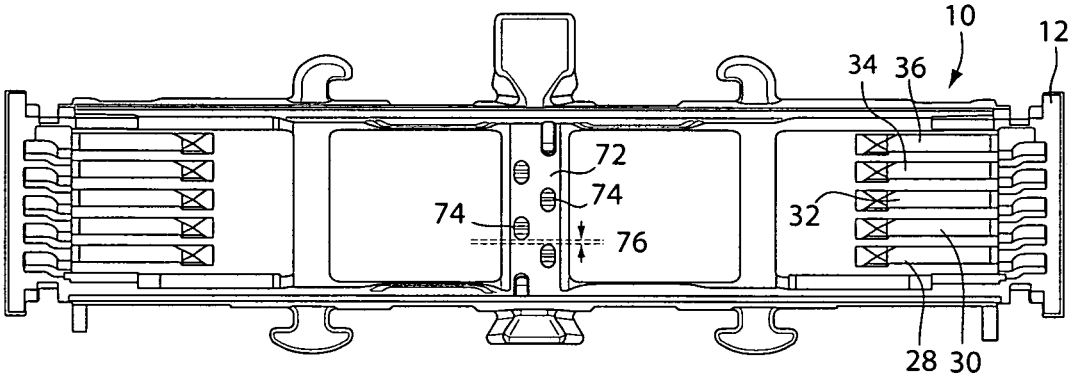
FIG. 2 is a top-plan view of a razor blade assembly with a blade support member with pegs in a slalom arrangement in accordance with an embodiment of the present invention.

In accordance with an embodiment of the present invention, FIG. 2 shows a top view of a cartridge or razor blade unit 10 for holding five blades, in which the blades and their retaining clips 24, 26 (of FIG. 1A) have been removed. Plastic leaf-spring arms 28, 30, 32, 34, and 36 are depicted in FIG. 2 on both sides of the cartridge 10. Cartridge 10 includes a support member 72 with pegs 74, wherein the support member 72 is mounted onto or into the housing 12 of the cartridge 10. As shown, the support member 72 with pegs 74 is centrally located in the cartridge housing 12 and perpendicular to the housing 12. Support member 72 with pegs 74 however may be located anywhere in the housing and also support member 72 may be positioned in parallel with the blades or housing 12. In an alternate embodiment of the present invention, pegs 74 may be attached elsewhere on the housing without being disposed upon a support member 72. For instance, the pegs could be individually mounted to the housing via peg arms extending from the housing, without the need of a support member.

In FIG. 2, the pegs 74 in support member 72 may be laid out in a slalom-like or zig-zag arrangement using six pegs 74. Five blades (not shown) can be positioned to rest up against the pegs 74 in the five openings 76 between the six pegs 74. The slalom-like arrangement allows for a robust steel layout in the tooling process.

In some embodiments, the number of pegs in the support member equals the number of blades in the cartridge, but in certain instances, the total number of pegs is one more than the total number of blades (as shown in FIG. 2) where each blade would be supported by two pegs, one in the front side of the blade and one in the back side of the blade. Additionally, it is contemplated that in some embodiments for instance, in a three-blade cartridge, only the second blade, only the second and third blades or all three blades may be supported by one or more pegs of the support member. Or in a five-blade cartridge, only the second and fourth blades may be supported, or the second, third, and fourth blades, or the first, third, and fifth blades, or all five blades may be supported with the pegs.

Each peg contacts and supports the bottom portion (front and/or back sides) of one of the multiple blades (or the bottom side of the blade carriers), thereby restricting fore and aft blade movement, i.e., lateral movements in the plane of the blade. This control of blade movement reduces the amplitude of blade vibration ("chatter") and/or blade deflection during shaving by about 40%, which in turn has been shown to improve overall shaving performance. Therefore, the pegs must be designed to be narrow enough to keep the blades from vibrating, but also to be loose enough so that they do not bind the blades. The pegs can have a width of, for example, from about 0.1 to about 0.3 mm, e.g., 0.15, 0.175, 0.2, 0.21. 0.225. The pegs may be as broad as the width of the support member, e.g., from about 2.0 to about 5.0 mm, e.g., 2.5, 3.0, 3.5, or 4.0 mm wide. The pegs can have a depth of about 1.5 to about 3.0 mm, e.g., 1.75, 2.0, 2.25, or 2.5 mm deep. Though parallel or straight sides on the pegs may be desirable, it is possible for the pegs to be designed otherwise, e.g. with about 1 degree of draft (wider from bottom to top).

Figure 2A:
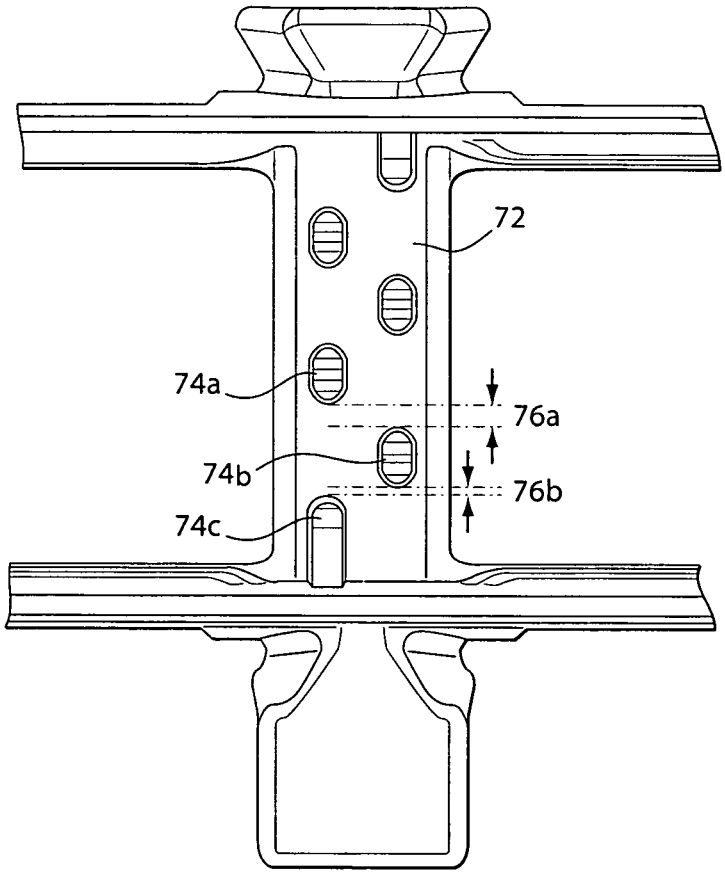
FIG. 2A is a top view of a razor blade assembly with pegs having different spans in accordance with an alternate embodiment of the present invention.

As mentioned above, any number of pegs and any number of blades may be utilized. Additionally, since different blade spans can be set, it follows that in some embodiments, the pegs 74 will not be equidistant from each other because the openings 76 between pegs 74 may be set according to the different blade spans, and thus the width of one opening 76 may not be the same as another opening 76. This is shown in FIG. 2A, where the distance between pegs or openings 76 varies across the length of the support member 72. For instance, the opening 76*a* between pegs 74*a* and 74*b* is larger than the opening 76*b* between pegs 74*b* and 74*c*.

As mentioned, the pegs aid in the control of the blades by potentially restricting both forward and rearward blade movement, which, in turn, reduces the amplitude of blade vibration and/or deflection during shaving. However, it is also contemplated that in different peg embodiments, one could constrain only rearward motion of the blades or only forward motion of the blades or any combination of blades constrained on forward motion while another combination of blades constrained on rearward motion. The level or amount of constraint could also be manipulated by varying the position of the blades in the openings and/or the position of the pegs to allow varying levels of deflection in either the forward or rearward direction.

Figure 1D:
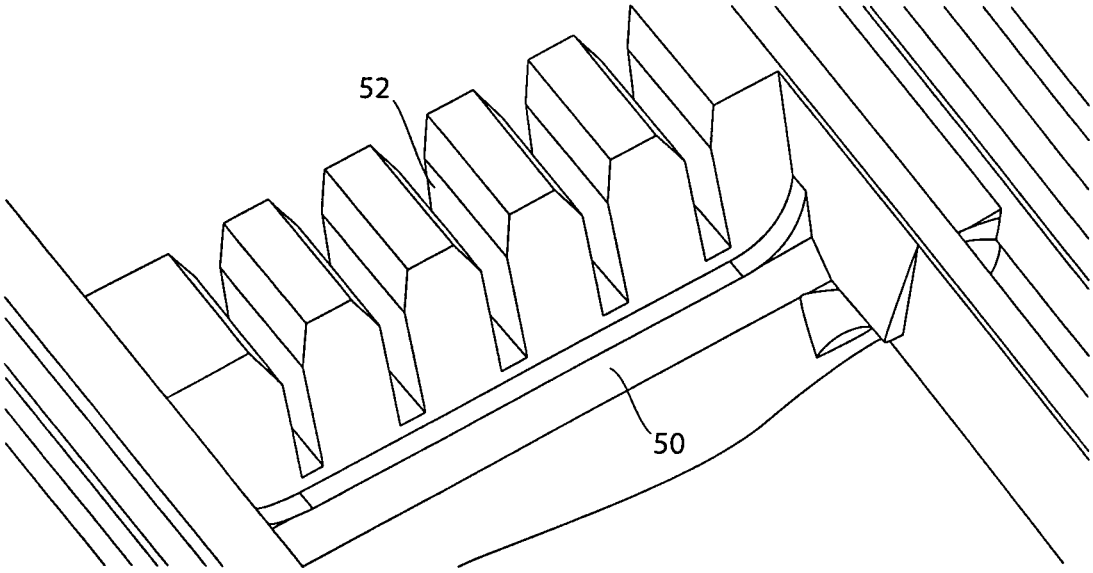
FIG. 1D is a perspective view of a razor blade assembly having a support member providing surface to surface contact with the blades.
Figure 3:
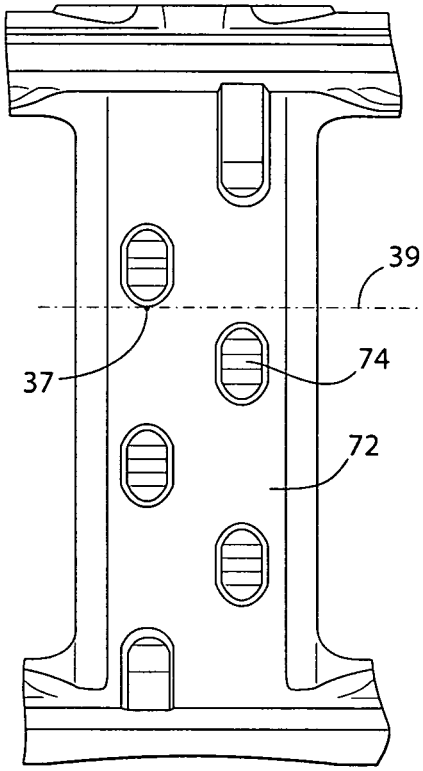
FIG. 3 is a top view depicting the line contact of the razor blade with pegs in accordance with an embodiment of the present invention.
Figure 5:
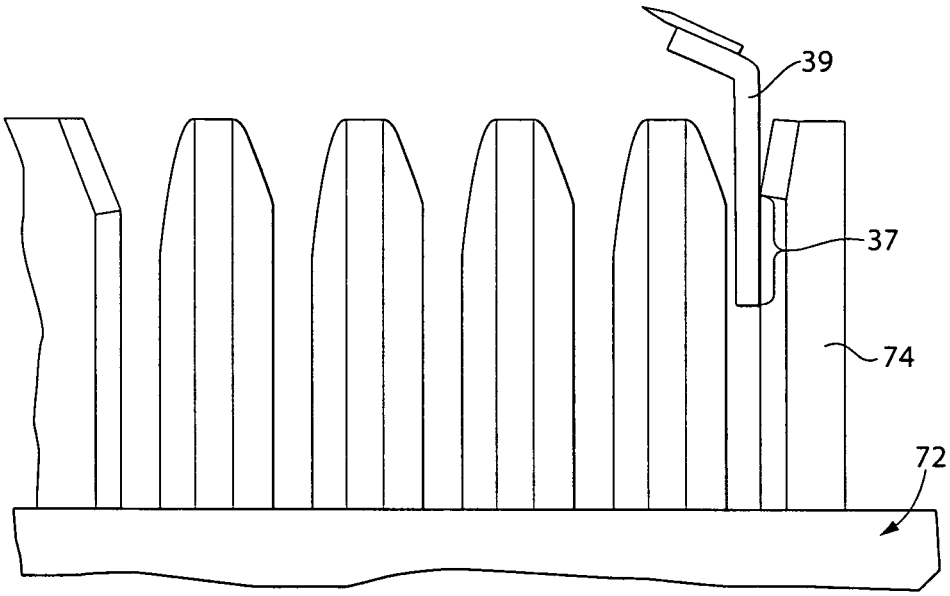
FIG. 5 is a side view depicting the line contact of the razor blade with pegs in accordance with an embodiment of the present invention.
Figure 5A:
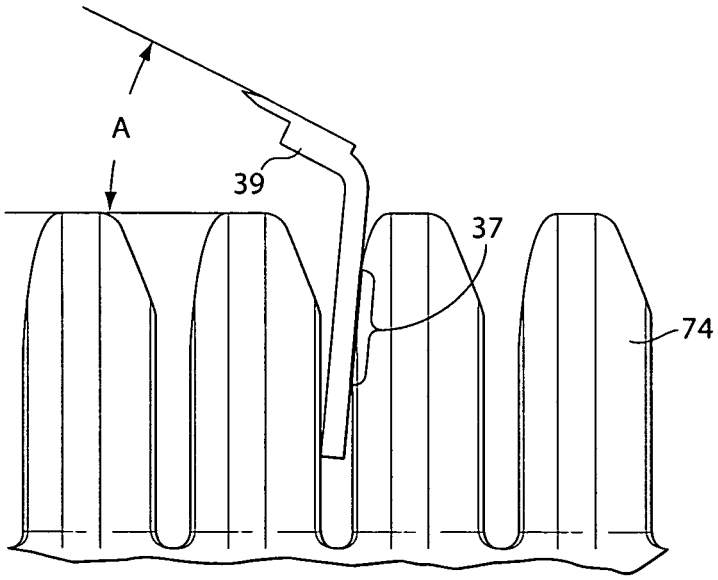
FIG. 5A is a side view depicting the line contact of the razor blade with pegs in accordance with another aspect of the present invention.

In accordance with another embodiment of the present invention, each peg 74 is cylindrical or rounded at least at the point of intersection or points of contact 37 with blade or blade carrier 39 as shown in FIGS. 3, 5, 5A such that a single line is formed. It is this intersection 37 of the peg 74 and the bottom portion (front and/or back side) of the blade or blade carrier 39 which may form either a single line contact (or a single point of contact, not shown) in accordance with this embodiment of the present invention. Rounded pegs are generally less complicated to mold, manufacture and assemble than other shapes. Furthermore, rounded pegs provide control and stability for the blades since the rounded pegs provides a desired line contact (or one line of intersection or contact) with the bottom side of the blade as shown in FIGS. 3, 5 and 5A; whereas if the pegs were rectangular or square such that the blade rested on a flat side of the rectangle or square, the pegs would provide a less desirable surface contact with the bottom side of the blade as depicted in FIG. 1D. It has been determined that for assembly, it is less onerous controlling and predicting only one point or line of intersection or contact of a peg with a blade than controlling and predicting an entire flat surface of contact of a peg with a blade.

Figure 4:
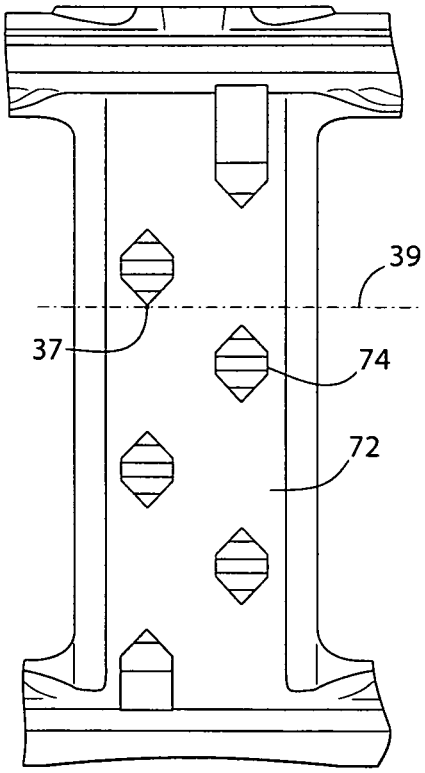
FIG. 4 is a top view depicting the line contact of the razor blade with pegs in accordance with an alternate embodiment of the present invention.

The present invention, however, contemplates that square or rectangular pegs may be arranged as shown in FIG. 4 (e.g. to look more diamond shaped) to provide the desired line contact 37 down the surface of the bottom portion or bottom side of the blade 39. Any other shape of peg or combination of shapes of pegs could ostensibly be utilized to obtain the desired line contact at the intersection of the peg and blade, however, it should be noted that it may be more complicated to manufacture and/or arrange certain peg shapes over others.

Accordingly, though all types of peg shapes and combinations of peg shapes are contemplated in the instant invention, a key aspect of the invention is that the pegs should have one point of contact or a line contact at the intersection with the blade bottom sides, this providing improved control and predictability over surface to surface contact in the prior art, while also providing uncomplicated manufacturability.

The line of contact 37 between the pegs and blades is further depicted in FIG. 5 which shows a side view of the pegs 74 on support member 72 and the bottom sides of the blades touching the pegs.

The width dimension of the single point of contact or single line of contact 37 in the present invention is less than about 0.05 mm for plastic material. This dimension value may vary based on tolerances when using different materials and manufacturing methods. However, an intersection that forms a line that is greater than about 0.05 mm wide may render the intersection to be greater than a line and trending towards becoming more of a surface, requiring more precision for control and more complex manufacturability.

In FIG. 5, non-rotated blade 39 essentially contacts the peg to form a full line of contact as depicted at intersection 37. The length dimension of the single line of contact 37 will change depending on the movement, rotation or tilt of the blades. Although the blades rotate varying amounts during use, they still contact the pegs and the blades slots, both of which prevent the blades from deflecting or translating. Thus, the extent of line contact that occurs between a rotated blade and the peg depends on the amount of rotation. For instance, if there is no blade rotation, there is substantially a full line of contact, while as the rotation or tilt increases, the line of contact likely becomes shorter than a full line of contact. Referring now to FIG. 5A, a blade tilted back an angle A of about 26.5 degrees which effectively provides a full rotation back, shortens the substantially full line of contact 37 shown in FIG. 5 to an intersection line of contact 37 of about 0.34 mm. Accordingly, the line of contact length is typically going to be greater than about 0.34 mm.

Though the slalom-like arrangement provides a stable, easy-to-manufacture design, referring now to FIGS. 6-9, pegs 74 in support member 72 may be laid out in several different embodiments as described below.

Figure 6:
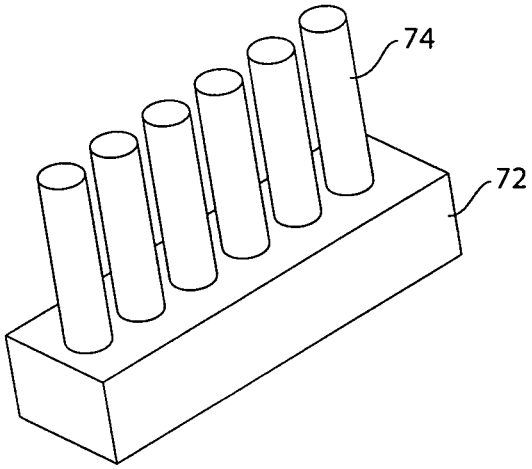
FIG. 6 is a perspective view of a blade support member with pegs in a linear arrangement in accordance with an alternate embodiment of the present invention.
Figure 7:
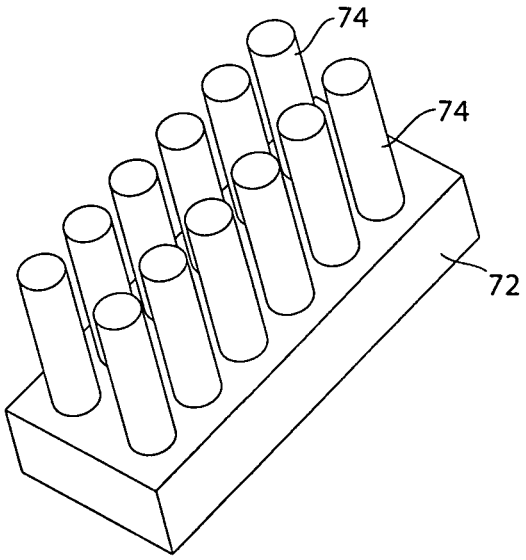
FIG. 7 is a perspective view of a blade support member with two columns of pegs in a linear arrangement in accordance with an alternate embodiment of the present invention.
Figure 8:
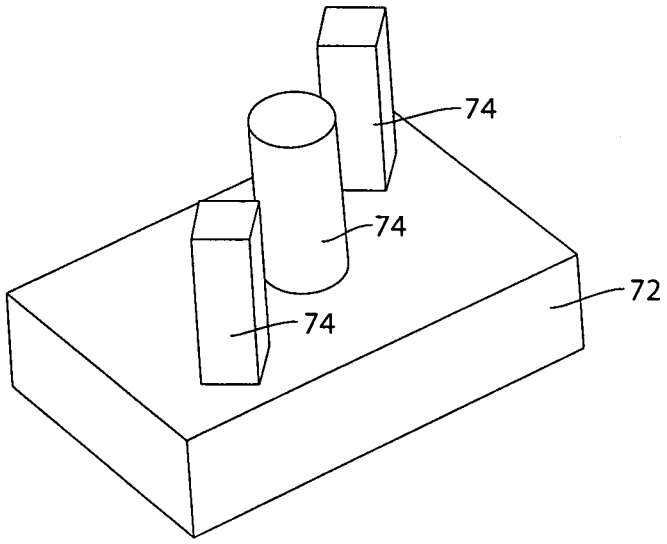
FIG. 8 is a perspective view of a blade support member with pegs in an angled linear arrangement.
Figure 9:
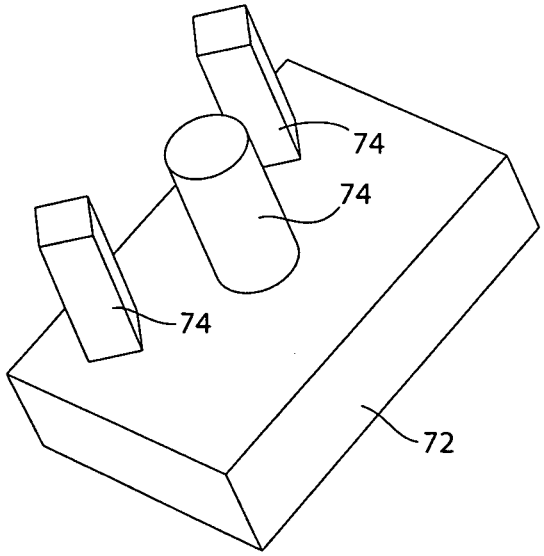
FIG. 9 is a perspective view of a blade support member with pegs in an offset arrangement.

In FIG. 6, rather than a slalom-like arrangement, a linear column of pegs 74 is shown. In FIG. 7, a layout of two linear columns of pegs 74 are shown in accordance with another alternate embodiment of the present invention. In FIG. 8, pegs are in an angled linear arrangement. In FIG. 9, pegs are offset from each other.

These arrangements (FIGS. 6-9) may be a design choice and may have pegs of any shape or combination and offer the same characteristics of providing blade stability and control as the slalom-like arrangement of pegs though they may be more cumbersome to mold or manufacture.

The support members 72 can be either flexible or rigid, and can be fitted as a separate part or integrally molded as part of the cartridge housing 12.

Much like the support member 72, the pegs 74 can be configured as flexible or rigid, but may be desirably rigid, and made from any kind of material, such as elastomeric, plastic or metal. If non-rigid pegs are desired, materials such as polyethylenes, thermoplastics, elastomers, or rubbers may be utilized. With rigid pegs, plastics such as polystyrene, ABS, rigid polyvinylchloride (PVC), polyamides, polyphenylenes, Noryl® (a polyphenylene oxide-styrene blend), or Noryl GTX® (a blend of polyamide (PA) or polyphenylene ether polymer (PPE))) may be utilized.

Figure 10A:
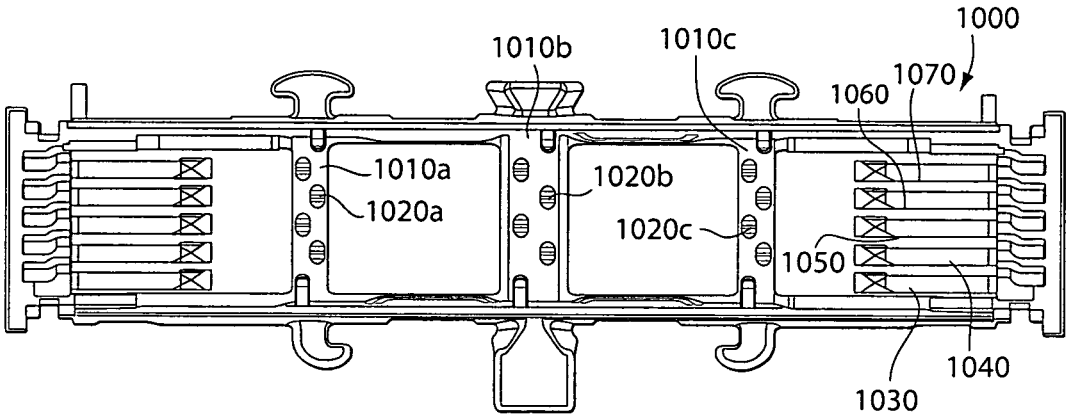
FIGS.10A and 10B are top plan views of a razor blade assembly having multiple blade support members with pegs in accordance with embodiments of the present invention.
Figure 10B:
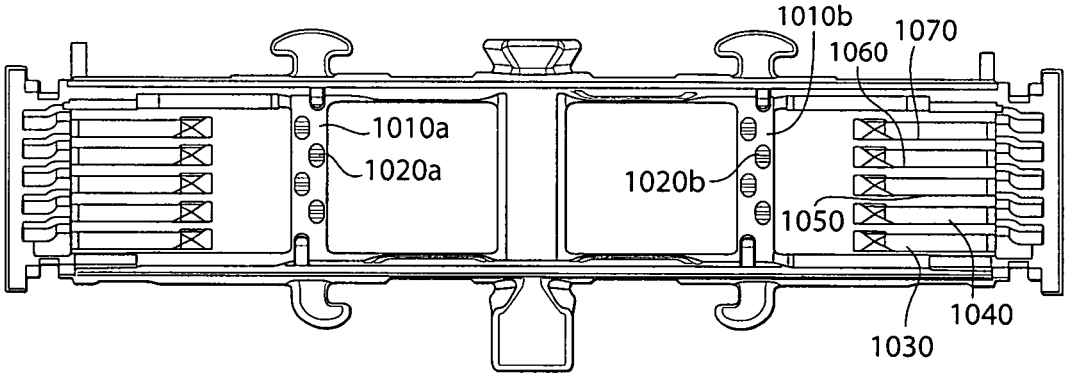

As shown in FIGS. 10A and 10B, there may be more than one (e.g., two, three, or more) blade support members 72 per cartridge in the present invention, in which case, they can be, but need not be, equally spaced along the width of the cartridge. FIG. 10A depicts three support members 1010*a*, 1010*b*, 1010*c* having pegs 1020*a*, 1020*b*, 1020*c*. The members 1010*a*, 1010*b*, 1010*c* are generally equally spaced along the width of the cartridge 1000 and inside the area of the spring fingers 1030, 1040, 1050, 1060, 1070. Pegs 1020*a* in the top surface of the support members 1010*a* are dimensionally similar to, and aligned with, pegs 1020*b* on support member 1010*b* which are likewise dimensionally similar to, and aligned with, pegs 1020*c* on support member 1010*c* at each end of the cartridge housing 1000. FIG. 10B depicts two support members 1010*a* and 1010*b* each respectively having pegs 1020*a* and 1020*b* aligned similarly as described above with FIG. 10A and inside the area of the spring fingers 1030, 1040, 1050, 1060, 1070. In FIG. 10B, two support members 1010*a* and 1010*b* are provided on either side of the center of the cartridge, but there is no centrally located support member in accordance with another embodiment of the present invention.

Figure 11:
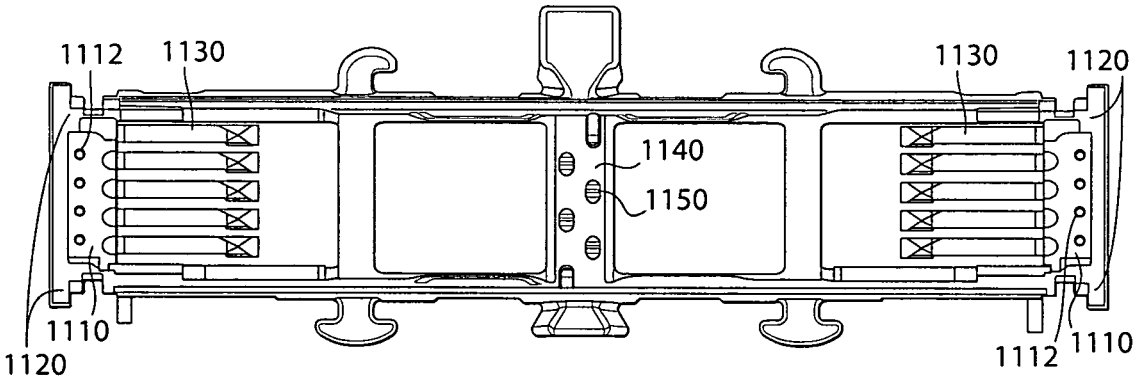
FIG. 11 is a top plan view of a blade support member with pegs at blade slot ends in accordance with another embodiment of the present invention.

Referring now to FIG. 11, in accordance with yet another embodiment of the present invention, a cartridge 1100 is shown having a support member 1110 with pegs 1112 at blade slot end 1120 and located at the base of the spring fingers 1130. Pegs 1112 provide support at the blade ends. It may be desirable that support member 1110 with pegs 1112 is located at both blade slot ends 1120 of the cartridge for symmetry and stability. In addition to support member 1110, FIG. 11 also depicts a centrally located support member 1140 with pegs 1150 arranged in a slalom-like fashion. Also contemplated in the present invention is the cartridge 1100 without a centrally located pegged support member 1140 or with two additional pegged support members, one on either side of the center of the cartridge as depicted for instance in FIG. 10B.

Likewise, as discussed above in conjunction with the pegged support member 72, 74 which is centrally (or elsewhere) located in the housing, having a pegged support member 1110 at the blade slot ends 1120 as shown in FIG. 11 makes assembly between the blades and housing easier and reduces the defects related to loading the blades into a cartridge.

This is the case because in the same manner as described above, the pegs located at blades slot ends, leverage the line contact formed between a peg (having a cylinder or round shape) and a bottom side of the blade, as opposed to surface to surface contact (FIG. 1D). Such a line contact during automated assembly requires less geometric control of the features involved and tolerates assembly related misalignment of components in an improved fashion.

As mentioned above, it may be advantageous to set the blades to have different exposures (or heights), e.g., increasing exposure progressing from the primary blade to the other blades. Therefore, it is also contemplated in the instant invention that pegs 1150 at the blades slot ends 1120 of FIG. 11 could also be aligned with the blades and set at different exposures (or heights). This may also be achieved without the need for spring members 1130.

Figure 12A:
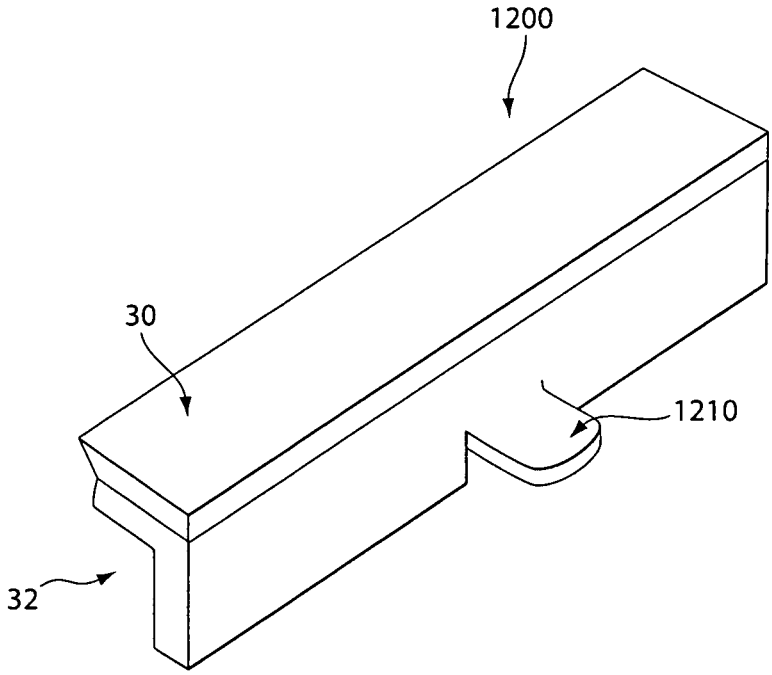
FIG. 12A is a perspective view of a blade carrier with pegs in accordance with yet another embodiment of the present invention.

Referring now to FIG. 12A, a perspective view of a pegged blade 1200 having a blade 30 with a blade carrier 32 is shown where a peg 1210 is attached to or part of the blade carrier 32 or formed from the blade carrier itself in accordance with yet another embodiment of the present invention. As shown in FIG. 12A, peg 1210 is formed from or comes out of the back side 33*b* of the bottom portion 42 of the blade carrier 32. Peg 1210 may be on either the front side 33*a* (not shown) or the back side 33*b* (shown) of the blade carrier 32 or more than one peg 1210 may be on both sides (not shown) or there may be more than one peg 1210 on each side (not shown).

Figure 12B:
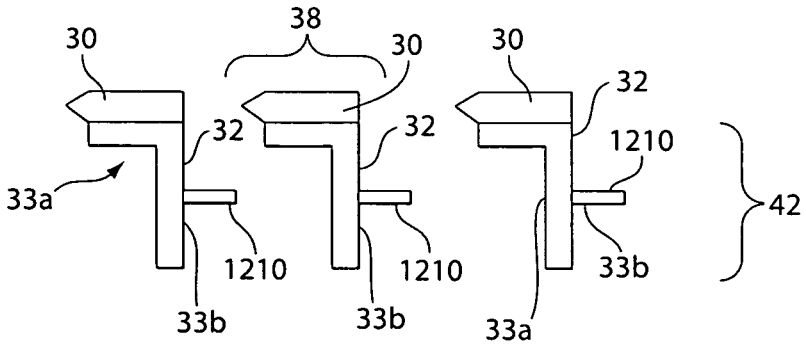
FIG. 12B is a side view of several blade carriers of FIG. 12A.

Peg 1210 is still capable of providing the full line of contact with the adjacent blade carrier if formed to be rounded or otherwise as described above. As shown in FIG. 12B, a side view of three blades with blade carriers is shown, each having pegs 1210 coming out of the bottom back side of the blade carrier, and thus contacting the adjacent blade carrier at its bottom portion 42, front side 33*a*. In this embodiment, a support member having pegs may not be necessary but could be provided.

The overall shape of the razor cartridge, with pegs and openings, remains the same, and the number of pegs, and their sizes, is a design choice but may be determined based on the number of blades desired to be supported.

The new shaving assemblies or razor cartridges described herein are used in the same manner as existing razor cartridges, with the only difference apparent to the user being improved shaving characteristics.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor blade unit comprising:

a housing;

a guard arranged at a front portion of the housing;

a cap arranged at a rear portion of the housing;

at least one blade comprising a sharp top edge and a bottom portion having front and back sides and being arranged essentially in parallel between the guard and the cap, wherein the at least one blade optionally comprises a blade carrier; and a plurality of pegs wherein one of said plurality of pegs contacts and supports the front side of said bottom portion of the at least one blade or the blade comprising said blade carrier, and an adjacent peg contacts and supports the back side of said bottom portion of the at least one blade or of the blade comprising said blade carrier, wherein an intersection between each peg and the blade or the blade comprising said blade carrier forms a single line of contact.

2. The razor blade unit of claim 1 wherein each of said plurality of pegs can be of any shape wherein said shape provides a single line of contact with at least one respective blade of said plurality of blades.

3. The razor blade unit of claim 1 wherein each of said plurality of pegs is round or cylindrically shaped.

4. The razor blade unit of claim 1, wherein each peg has a width that is greater than a thickness of the blade.

5. The razor blade unit of claim 1, wherein each peg has a width of from about 0.1 to about 0.3 mm, a breadth of from about 2.0 to about 5.0 mm, and a depth of from about 1.5 to about 3.0 mm.

6. The razor blade unit of claim 1, wherein said plurality of pegs comprises an elastomeric material, a plastic or a metal.

7. The razor blade unit of claim 1, wherein the at least one of the pair of support members is located centrally in the housing.

8. The razor blade unit of claim 1 wherein said at least one of the pair of support members is located at a blade slot end.

* * * * *